US008985348B2

(12) United States Patent
Prado

(10) Patent No.: US 8,985,348 B2
(45) Date of Patent: Mar. 24, 2015

(54) BRA ORGANIZER

(71) Applicant: Frances Prado, Jamul, CA (US)

(72) Inventor: Frances Prado, Jamul, CA (US)

( * ) Notice: Subject to any disclaimer, the term of this patent is extended or adjusted under 35 U.S.C. 154(b) by 98 days.

(21) Appl. No.: 13/686,780

(22) Filed: Nov. 27, 2012

(65) Prior Publication Data

US 2014/0144952 A1 May 29, 2014

(51) Int. Cl.
*A47F 7/00* (2006.01)
*A47G 25/18* (2006.01)
*A47G 25/14* (2006.01)

(52) U.S. Cl.
CPC ..... *A47G 25/18* (2013.01); *A47G 2025/1492* (2013.01)
USPC ..... 211/85.3

(58) Field of Classification Search
CPC ..... A47G 2025/1492; A47G 2025/40; A47G 25/14; B65D 85/18; A45C 3/004; D06F 59/02
USPC ..... 206/278, 45.24, 45.25, 515, 771, 470, 206/526, 462; 211/85.3, 119.004, 113, 118, 211/35
See application file for complete search history.

(56) References Cited

U.S. PATENT DOCUMENTS

| | | | | | |
|---|---|---|---|---|---|
| 3,139,133 | A * | 6/1964 | Spector | 190/111 |
| 3,837,476 | A * | 9/1974 | Schwartz | 206/45.24 |
| 4,119,203 | A * | 10/1978 | Kuchenbecker | 206/461 |
| 5,779,033 | A * | 7/1998 | Roegner | 206/6.1 |
| 5,800,027 | A * | 9/1998 | Dunn | 312/138.1 |
| 5,803,254 | A * | 9/1998 | Vasudeva | 206/373 |
| 5,896,996 | A * | 4/1999 | Chuang | 206/769 |
| 6,308,832 | B1 * | 10/2001 | Pirro et al. | 206/469 |
| 6,364,115 | B1 * | 4/2002 | Casanova et al. | 206/471 |
| 7,712,850 | B2 * | 5/2010 | Vasudeva | 312/328 |
| 2008/0289978 | A1 * | 11/2008 | Malick | 206/278 |
| 2010/0193383 | A1 * | 8/2010 | Parness | 206/288 |
| 2012/0205332 | A1 * | 8/2012 | Anderson | 211/85.1 |

* cited by examiner

*Primary Examiner* — Korie H Chan
(74) *Attorney, Agent, or Firm* — Ernesto Garcia

(57) ABSTRACT

An organizer for keeping bras and accessories organized in a closet. The organizer is able to be hung in the closet and contains storage compartments that make the bras visible for color selection. A series of holders from either side of the organizer provides sufficient storage space for storing one bra or multiple stacked bras. The holders contains a pair of bra cavities which allow the sitting of the bra cups in their pre-tended wear form so as to expand in their natural form without deforming the bra cups.

21 Claims, 3 Drawing Sheets

BRA ORGANIZER

PRIORITY INFORMATION

The present invention claims priority to U.S. Provisional Application Ser. No. 61/565,647 filed, Dec. 1, 2011.

BACKGROUND OF THE INVENTION

In the realm of organizing, many women find themselves unable to organize their plethora of bras. Many women rather toss the bras in a drawer as the most common habit. However, tossing the bras in a drawer makes the bras tangle with each other and in the process distort or crush the cups thus deforming the smooth shape of the cups.

Other females have the tendency to hang the bras by their straps in a hook as a way to keep them organized or hang the bras in anything around the bedroom or bathroom. These approaches make the straps loose its elasticity and make an eye soar in keeping things organized.

SUMMARY OF THE INVENTION

The invention is geared towards a bra organizer to keep the bras neatly organized and give each woman the satisfaction of being organized as well.

The bra organizer is substantially a flat rectangular baseboard that can be hung. The baseboard can be used to organize bras on either one side of both sides.

Attached to the baseboard are multiple holders that have bra cups. The bra cups are transparent so that you can see the color of the bra. Each of the holders can open and close using a latch. A zipper pocket or pouch is right above or at the same level of each holder to store extra bra straps or matching underwear. A transparent window will be in communication with the zipper pocket so that one can see contents inside the zipper pocket.

The unique feature is that each of the bra holders can hold multiple bras in their intended form so as to make the bras look worn by a person. The bra organizer is designed to hang in the closet to maximize space. It allows women to have convenient access to bras and undergarments. The organizer will make the bras last significantly longer without the abuse they would have faced if the bras were placed inside a dresser drawer.

DETAILED DESCRIPTION OF THE INVENTION

Figure 1:
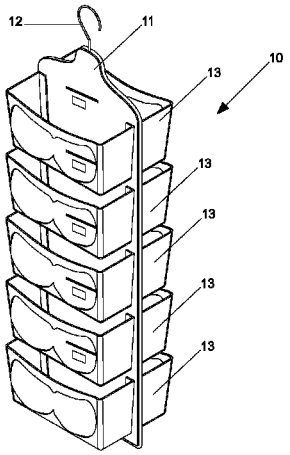
FIG. 1 is an isometric view of the bra organizer.
Figure 2:
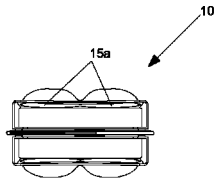
FIG. 2 is a top view of the bra organizer.
Figure 3:
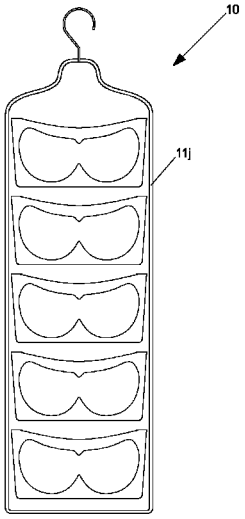
FIG. 3 is a front view of the bra organizer.

FIG. 1 shows a bra organizer 10 in an assembled state. The organizer 10 comprises multiple holders 13 that keep at least one bra, not shown, in place. For the sake of discussion, it is contemplated that more than one bra would be organized singly or stacked together in each holder 13. The bra organizer 10 comprises a baseboard 11 that contains several holders 13 that pivot relative to the baseboard 11. The pivotable motion sets forth open and closed positions of the holders so that one can access a bra or accessory. In the closed position, the holder 13 is kept closed by a magnetic latch. To pivot the holder, one must exert a force enough to overcome the magnetic attraction of a magnet 13*c* and a ferromagnetic tab 11*c* or, alternatively, between two magnets which make up the magnetic latch. For the sake of illustration, the magnet 13*c* will attract the ferromagnetic tab 11*c* but of course two magnets could easily accomplish the same magnetic attraction. The ferromagnetic tab 11*c* is connected to the baseboard 11 using fasteners 11*h* such as nails screws, bolts, or rivets. Of course the tabs 11*c* alternatively can be glued thereon.

Figure 5:
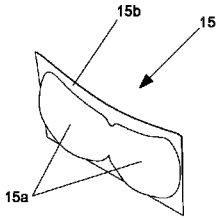
FIG. 5 shows an isometric view of a window insert used in the bra organizer.
Figure 6:
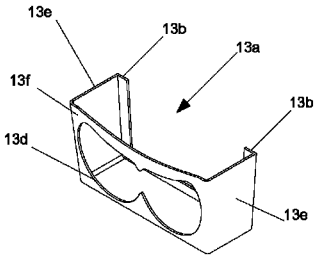
FIG. 6 shows an isometric view of the holder showing the front side.
Figure 7:
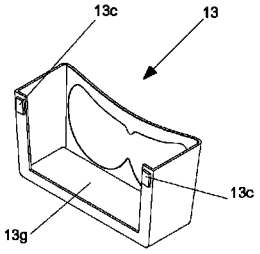
FIG. 7 shows an isometric view of the holder showing the backside.

As shown in FIGS. 6 and 7, each of the holders 13 includes a top-opened and side-opened container 13*a*. The top of the container 13*a* is opened so that one can have access to a bra and the bra be retrieved or organized. The container 13*a* further comprises a pair of sidewalls 13*e*, a bottom wall 13*g*, and a front wall 13*f*. The front wall 13*f* contains a window opening 13*d* resembling a perimeter of bra cups. The window opening 13*d* is provided with a window insert 15 that is transparent or semitransparent, see FIG. 5. The window insert 15 contains a pair of bra cups 15*a* to receive the bra cups of a bra. The bra cups 15*a* project beyond the window opening 13*d* so that the bra cups 15*a* extend beyond the front wall 13*f* of the container 13*a*. The window insert 13*d* contains a border 15*b* around the bra cups 15*a* so that it is adhered to the front wall 13*f* of the container 13*a* within the container 13*a*. The backside of the container 13*a* contains a pair of flanges 13*b* where magnets 13*c* are glued on.

Figure 8:
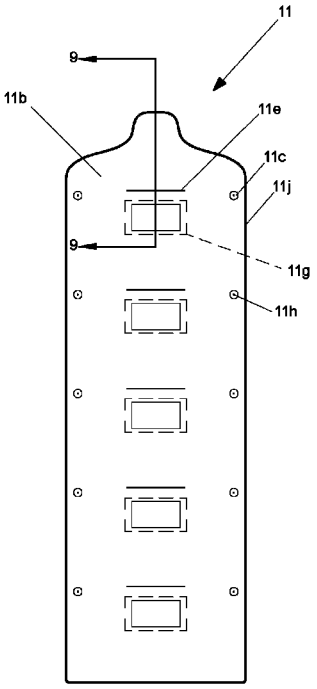
FIG. 8 shows a front view of the baseboard containing its cover.
Figure 9:
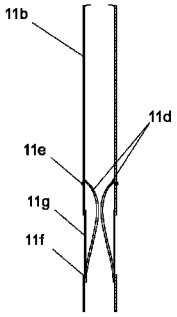
FIG. 9 shows a partial cross-section view 9-9 shown in FIG. 8.

As shown in FIG. 8, the baseboard 11 is comprised of a cover 11*b*. The cover conforms to the shape of the board 11*a* and houses the board 11. The cover 11*b* contains a cording edge 11*j* that goes around the perimeter of the cover 11*b*. The cover 11*b* contains at least one zipper 11*e* accessing a pocket 11*d* that is within the cover 11*b*. At least a window opening 11*f* is cut out from the cover 11*b* so that one can determine contents inside the pocket 11*d*. The window opening 11*f* is covered with a clear window 11*g* that is sawn or glued onto the cover 11*b* as seen in FIG. 9. The location of the pocket 11*d* will be in the same location where the holders 13 will be located.

Figure 4:
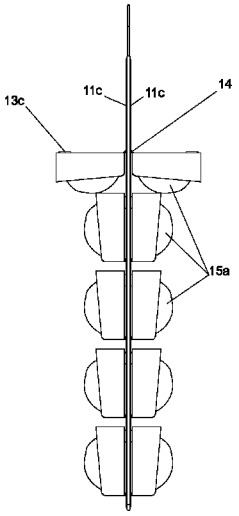
FIG. 4 is a side view of the bra organizer.
Figure 10:
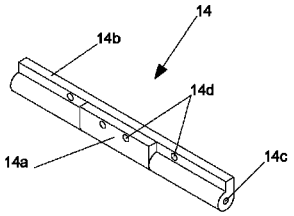
FIG. 10 shows an isometric view of a hinge used to connect the holders to the baseboard.

As shown in FIG. 10, hinge 14 is utilized to make the holders 13 pivotable relative to the baseboard 11. The hinge 14 comprises a first portion 14*a* that is fastened to a lower portion of the container 13 on the backside. A second portion 14*b* is fastened to the baseboard 11 using fasteners that pass through fastener openings 14*d*. The first portion 14*a* and the second portion 14*b* are pivotally connected using a pivot pin 14*c*. The hinge 14 will be located so that it is hidden from view when one looks straight onto the holders 13 but of course the hinge 14 can be made visible when looking straight onto the holders 13. The hinge 14 will be space evenly along the baseboard to allow the holder 13 to open perpendicular to the baseboard 11 as seen in FIG. 4. In this position shown in FIG. 4, the bottom wall 13*g* will hinge parallel to the baseboard 11.

Figure 11:
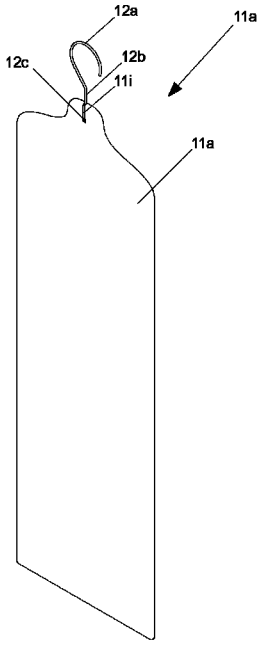
FIG. 11 shows an isometric view of a board, without its cover, used to make the baseboard.
Figure 12:
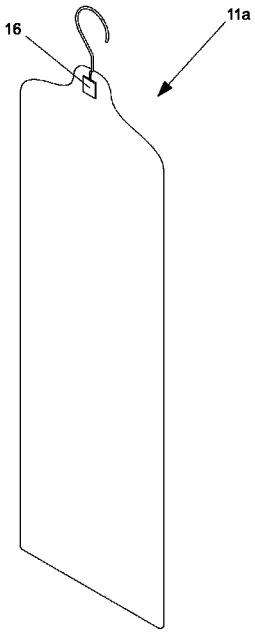
FIG. 12 shows an isometric view of an assembled board

As shown in FIG. 11, the board 11*a* that makes the baseboard 11 is comprised of a solid planar board 11*a* made from any known material. Although not shown, the board 11*a* can be hollowed out or contain openings to reduce the weight. The board 11*a* contains a portion that simulates part of a clothes hanger. The board 11*a* further includes a hanger 12 comprising a hook 12*a* and an anchor portion 12*b*. At the end of the anchor portion 12*b* is a cylindrical flange 12*c* that is used to make the hook 12*a* rotatable relative to the board 11*a*. Both the anchor portion 12*b* and the cylindrical 12*c* flange fit in a T-shape slot 11*i* on the board 11*a*. The T-shape slot 11*i* is then covered with a pair of plaques 16 from either side of the board 12*a*. Each of the plaques 16 can be riveted, fastened with screws, or adhered to the board 11*a*. Of course, the method of connection can be made by any fashion as long as the plate prevents the hanger 12 from laterally coming out of the t-slot 11*i* as shown in FIG. 12.

Figure 13:
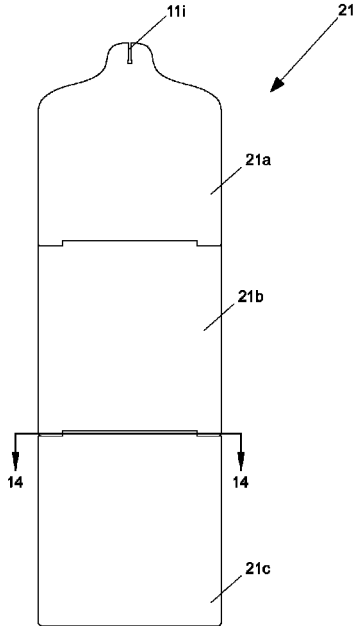
FIG. 13 shows a front view of a second embodiment of the board.
Figure 14:
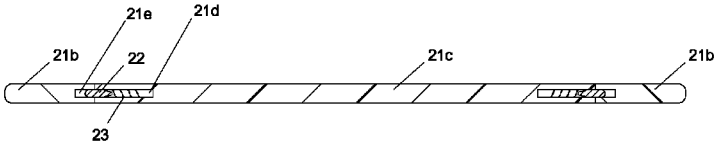
FIG. 14 shows a cross-sectional view of a hinge connection between sections of the board shown in FIG. 13.

FIG. 13 shows an alternative embodiment of the board 21 used to make a baseboard. In this version, the board 21 is sectioned into three portions 21*a*-21*c* so that the baseboard is able to collapse and be made less bulky. The first portion 21*a* is pivotally connected to the second portion 21*b*, which in turn, is pivotally connected to the third portion 21*c*. The pivot connection is similar to those found in watches. As shown in FIG. 14, for example, the third portion 21*c* contains opposite housing openings 21*d* which house a slidable pin 22 that is biased with a coil spring 23. The slidable pin 22 is then biased to lock into a pin opening 21*e* on the second portion 21*b* of the board 21 thus keeping the third portion locked with the second portion.

The bra organizer is not only intended for displaying and organizing bras but can as well can be used to store and display, camis, bathing suits, or bikinis. Even though there is no significant in materials, all components can be made from any known material. The cover 11*b*, preferably, will be made from vinyl and the cover made permanent with the board 11*a*. Of course, the cover 11*b* can also be made removable and made with a washable cloth material. The invention is also envisioned in that the hinge connection of the holders 13 can be made using a separate hinge 14, as demonstrated, or made integral with the holders 13. It is also envisioned that live hinges can be used in lieu of mechanical hinges as long as the holders or board sections 21*a*-21*c* are allowed to pivot. Furthermore, as shown in FIG. 4, the holders 13 do not need to pivot until being perpendicular to the baseboard 11. The rotational range of motion could be limited by spacing the holders 13 much closer to each other thus limiting the rotational motion of the holders 13.

Even though magnetism is the prefer approach in keeping the holders in the closed position for the latch, it is also envisioned that other types of mechanical fasteners can be used such as hook and loop fasteners, or snap connections.

The invention claimed is:

1. An organizer comprising a baseboard, at least one holder, and at least one window insert;

wherein the holder comprises a top-opened and side-opened container including a window opening; and, wherein the window insert comprises a pair of cups projecting through the window opening.

2. The organizer of claim 1, wherein the container is pivotally connected to the baseboard and contains at least one latch.

3. The organizer of claim 2, wherein the latch comprises a magnet fixed on the container and a ferromagnetic tab fixed on the baseboard.

4. The organizer of claim 2, wherein the container is a top-opened and side-opened container; and, wherein the container further comprises a pair of flanges and the latch is fixed to the flanges.

5. The organizer of claim 1, wherein the window opening has a perimeter in the shape of a pair of bra cups and the cups of the window insert contains a corresponding shape.

6. The organizer of claim 5, wherein the window insert contains a border surrounding the pair of cups.

7. The organizer of claim 6, wherein the border is abutting against the inside of the container or adhered to the inside of the container.

8. The organizer of claim 1, wherein the baseboard comprises a board and a hanger including a hook.

9. The organizer of claim 8, wherein the board further includes a T-slot accommodating an anchor portion and a cylindrical flange of the hanger.

10. The organizer of claim 9, wherein the T-slot is enclosed with a pair of plaques fixed to the board from opposite sides of the board.

11. The organizer of claim 10, wherein the board is comprised of at least two sections that are joined with a pivot connection.

12. The organizer of claim 11, wherein the pivot connection comprises a pair of pins that are each biased by a spring housed in a housing opening in one of the two sections and sliding onto a pin opening on the other section.

13. The organizer of claim 10, wherein the baseboard comprises a cover covering the board.

14. The organizer of claim 12, wherein the baseboard comprises a cover covering the board.

15. The organizer of claim 3, wherein the baseboard further comprises an additional holder on the same side of the baseboard where the at least one holder is located or on the opposite side of the baseboard where the at least one holder is located.

16. The organizer of claim 14, wherein the cover comprises a zipper accessing a pocket fastened to the inside of the cover.

17. The organizer of claim 16, wherein the cover further comprises a window opening and a window covering the window opening of the cover forming part of the pocket.

18. The organizer of claim 17, wherein the window is transparent or semi-transparent.

19. The organize of claim 1, wherein the window insert is transparent or semi-transparent.

20. An organizer comprising a baseboard, at least one holder, and at least one window insert;

wherein the holder comprises a top-opened and side-opened container including a window opening;

wherein the window insert comprises a pair of cavitics cups projecting through the window opening;

wherein the container is connected to the baseboard;

wherein the baseboard includes a hanger; and wherein the baseboard further includes a cover having at least one pocket within the cover.

21. An organizer comprising a baseboard, at least one holder, and at least one window insert;

wherein the holder comprises a container including a window opening; and, wherein the window insert comprises a pair of cups projecting through the window opening; and, wherein the container is pivotally connected to the baseboard and contains at least one latch.

* * * * *